US008187054B2

(12) United States Patent
Redenius

(10) Patent No.: US 8,187,054 B2
(45) **Date of Patent: *May 29, 2012**

(54) ADJUSTABLE BREAST POSITIONING SYSTEM FOR WOMEN'S GARMENT

(76) Inventor: Ronald J. Redenius, Citrus Heights, CA (US)

( * ) Notice: Subject to any disclaimer, the term of this patent is extended or adjusted under 35 U.S.C. 154(b) by 114 days.

This patent is subject to a terminal disclaimer.

(21) Appl. No.: 12/711,469

(22) Filed: Feb. 24, 2010

(65) Prior Publication Data

US 2010/0210179 A1 Aug. 19, 2010

Related U.S. Application Data

(63) Continuation-in-part of application No. 12/290,163, filed on Oct. 27, 2008, now Pat. No. 7,677,951, which is a continuation-in-part of application No. 11/809,463, filed on May 31, 2007, now Pat. No. 7,497,760, which is a continuation-in-part of application No. 11/059,194, filed on Feb. 16, 2005, now Pat. No. 7,452,260.

(60) Provisional application No. 60/579,566, filed on Jun. 14, 2004.

(51) Int. Cl.
*A41C 3/00* (2006.01)

(52) U.S. Cl. ..... 450/59; 450/60

(58) Field of Classification Search ..... 450/59–63, 450/65, 67, 68, 78; 2/104–106, 113–115, 2/90, 67, 73, 78.1–78.4
See application file for complete search history.

(56) References Cited

U.S. PATENT DOCUMENTS

| | | | | |
|---|---|---|---|---|
| 1,590,693 | A * | 6/1926 | McKeefrey | 450/61 |
| 2,175,676 | A * | 10/1939 | Walters | 450/63 |
| 2,421,448 | A * | 6/1947 | Witkower | 450/63 |
| 2,621,328 | A * | 12/1952 | Duchnofskey | 450/53 |
| 2,734,193 | A * | 2/1956 | Panes | 450/63 |
| 5,590,443 | A * | 1/1997 | Fildan | 24/200 |
| 7,452,260 | B2 * | 11/2008 | Redenius | 450/63 |
| 7,497,760 | B2 * | 3/2009 | Redenius | 450/60 |
| 7,677,951 | B2 * | 3/2010 | Redenius | 450/60 |
| 2005/0277364 | A1 * | 12/2005 | Redenius | 450/41 |
| 2007/0232190 | A1 * | 10/2007 | Redenius | 450/41 |
| 2009/0031731 | A1 * | 2/2009 | Ziminsky et al. | 60/777 |

* cited by examiner

*Primary Examiner* — Gloria Hale
(74) *Attorney, Agent, or Firm* — John K. Buche; Buche & Associates, P.C.

(57) ABSTRACT

An adjustable breast positioning system for a breast received within a breast cup of a woman's garment comprising a platform situated within a lower region of the breast cup; a shaping member at least partially overlaying the platform wherein the platform and shaping member are open to the top portion of the breast cup; and a connector having one end coupled to the platform and another end connected to an anchor moveably mounted to the garment for adjusting the platform for reducing the available volume for the breast within the breast cup and for concomitantly pushing the shaping member upward and inward for displacing the breast upward, forward, and inward toward the center of the wearer's chest while simultaneously increasing the volume of the breast outside the top portion of the breast cup for providing an improved visual presentation of the breast.

3 Claims, 10 Drawing Sheets

ADJUSTABLE BREAST POSITIONING SYSTEM FOR WOMEN'S GARMENT

CROSS-REFERENCE TO RELATED APPLICATIONS

This application is a continuation-in-part of U.S. patent application Ser. No. 12/290,163 filed Oct. 27, 2008 (now U.S. Pat. No. 7,677,951 (issued Mar. 16, 2010)), which is a continuation-in-part patent application of U.S. patent application Ser. No. 11/809,463, filed May 31, 2007 (now U.S. Pat. No. 7,497,760 (issued Mar. 3, 2009)), which is a continuation-in-part patent application of U.S. patent application Ser. No. 11/059,194, filed Feb. 16, 2005 (now U.S. Pat. No. 7,452,260 (issued Nov. 18, 2008)), which claims priority under 35 USC Section 119(e) to U.S. Provisional Application Ser. No. 60/579,566, filed Jun. 14, 2004, all of which are incorporated herein by reference in their entireties.

FIELD OF THE INVENTION

This invention relates generally to an adjustable breast positioning system for women's garments having breast cups and, in particular, to an adjustable breast positioning system for a brassiere or bra having breast cups wherein the adjustable breast positioning system independently reduces the available volume for each breast within each respective breast cup and displaces each breast upward, forward, and inward toward the center or cleavage area of the wearer's chest while concomitantly increasing the volume of each breast outside an upper portion of each respective breast cup for providing an improved visual presentation of the breast, a cosmetic enhancement of the breast, and/or a fashion trend.

BACKGROUND OF THE INVENTION

Although bras have been available for many years and featured a variety of forms, modern bras remain inadequate in achieving cosmetic enhancement and/or fashion trend goals while still remaining comfortable. This is because most conventional bras lift and shape the breasts, but do so in a way that actually compresses them against the woman's chest. Accordingly, although they may be higher and better shaped, comfort is compromised. Hence, there is a need for a bra that overcomes the significant shortcomings of excessively compressing or unnaturally constricting the breasts.

In addition, while lift and cleavage may be enhanced in a conventional bra, the breasts may actually be reduced in size or projection from a profile perspective due to the compression of the bra. Hence, there is a need for a bra that overcomes the significant shortcomings of providing a reduced profile projection of the breast.

Furthermore, for many women, the two breasts are not identical in size and for some the difference is even more pronounced due to nature or injury. Accordingly, it may be desired to shape one breast more than the other. However, conventional bras fail to provide independent cup adjustment to an adequate degree and any vertically oriented adjustment is accomplished by adjusting the shoulder strap of the bra which has the effect of simultaneously raising and tightening, or simultaneously lowering and loosening the entire bra apparatus.

Moreover, bras typically fail to provide adjustability of the breast outside the perimeter of the cup or what is termed herein as the outside-of-cup appearance.

For the foregoing reasons, there is a need for a bra that overcomes the significant shortcomings of the known prior-art as delineated hereinabove.

BRIEF SUMMARY OF THE INVENTION

In general, and in one aspect, an embodiment of the invention provides an adjustable breast positioning system for women's garments having breast cups wherein the adjustable breast positioning system varies the volume capacity of each breast cup individually for controlling both the degree to which the breast is shaped within the confines of each breast cup and the manner in which the breast is partially presented outside an upper periphery or perimeter of each breast cup for what is herein termed as the outside-of-cup appearance.

Viewed from another aspect, an embodiment of the invention provides an adjustable breast positioning system for women's garments having breast cups wherein the adjustable breast positioning system allows for independent positioning of each breast by positioning the breasts upward, projecting the breasts forward away from the chest, orienting the breasts closer together or toward a center or cleavage area of a wearer's chest, and increasing the volume of the breast outside the upper portion or perimeter of each breast cup for providing an improved visual presentation of the breast, a cosmetic enhancement of the breast, and/or a fashion trend.

In particular, and in one embodiment, the adjustable breast positioning system comprises for each breast cup, a pliable platform or rocker arm member situated within a lower region of each breast cup; a shaping member at least partially overlaying the platform member within each breast cup wherein the platform and shaping members are open to the top portions of the breast cup; and means for adjusting the pliable platform within each breast cup for creating a pushing force on the breast for positioning the breasts upward, projecting the breasts forward away from the chest, orienting the breasts closer together or toward a center or cleavage area of a wearer's chest, and increasing the volume of the breast outside the upper portion or perimeter of each breast cup for providing an improved visual presentation of the breast, a cosmetic enhancement of the breast, and/or a fashion trend.

Additionally, and in one embodiment, the adjusting means comprises for each breast cup, a connecting member having one end attached to one end of the platform for suspending the platform between the connecting member and a location where the platform attaches in the breast cup. The adjusting means further comprises an anchor element attached to an end of the connecting member opposite the end connected to the platform wherein the anchor element attaches to a strap rising up from the breast cup to which the strap is attached such that each breast may be independently adjusted.

Furthermore, and in one embodiment, the shaping member, when in a first, initial, or "at rest" position, lines a portion of the inside surface of the breast cup from the upper corner near the shoulder, down the outer side to the underside of the breast, and on to near the center of the chest. In that position the shaping member supports the lower and outside areas of the breast. In one embodiment, the shaping member is attached to the breast cup in the area of the upper corner near the shoulder.

Moreover, and in one embodiment, a guide or control member attaches at one end to the bottom of the bra cup and at another end to the platform. As the connecting member is moved, it causes the platform to suspend upward from the point where it attaches to the breast cup. The control member constrains this motion to keep the platform near the body of the wearer. This ensures the platform positions the breast and does not merely traverse up along the breast and away from the body.

While embodiments discussed may reference bras, the breast positioning system of the present invention can be applied to any women's garment with breast cups, and any women's garment having breast cups could incorporate the system.

Accordingly, it should be apparent that numerous modifications and adaptations may be resorted to without departing from the scope and fair meaning of the claims as set forth herein below following the detailed description of the invention.

DETAILED DESCRIPTION OF THE INVENTION

Figure 1:
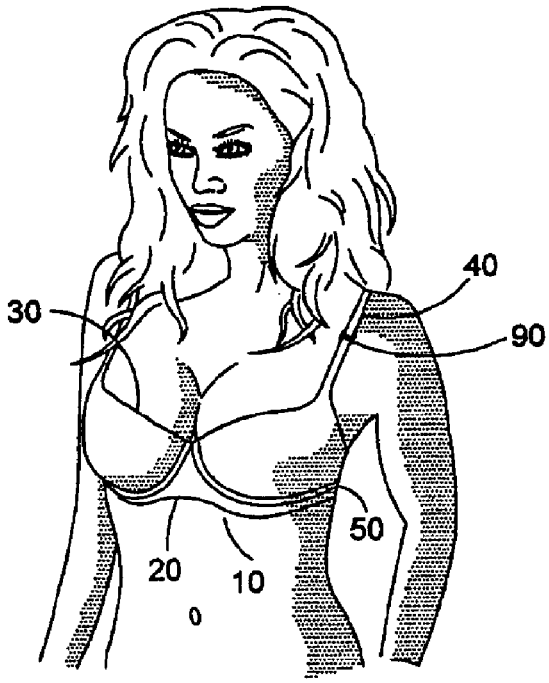
FIG. 1 shows an adjustable breast positioning bra being worn.

Considering the drawings, wherein like reference numerals denote like parts throughout the various drawing figures, reference numeral 10 is directed to an adjustable breast positioning garment comprising breast cups and an adjustable breast positioning system for independently displacing the breast upward, forward, together, and further outside the confines of the breast cups for accentuating cleavage and increasing the apparent size of the breast for providing an improved visual presentation of the breast, a cosmetic enhancement of the breast, and/or a fashion trend.

FIG. 1 shows one embodiment of an adjustable breast positioning bra 10 being worn and comprising in combination: a chest band or encircling portion 20 that wraps around or passes around the torso of a wearer; breast cups 30 attached to the front of the chest band, or incorporated into the front of the chest band; shoulder straps 40, which attach to the breast cups 30, pass over the shoulders, and attach to the chest band or encircling portion 20 at the back of the wearer, and; for some bras 10, a stiffening device 50 such as an under-wire or plastic member 50 that is incorporated into the bra 10 at the junction of the chest band 20 and breast cups 30 and which partially encircle the breasts on the bottom side. Breast cups 30 may be made of more than one layer with some of those layers possibly made of a thicker padding material, or thicker padding material may be inserted between layers. Also, some layers, such as a padding layer, may extend over only a portion of breast cup 30 as it is not necessary that all layers cover the same area.

FIGS. 2 through 9 show an embodiment of the adjustable breast positioning bra 10 which includes: back bands 25, which connect at the back of a wearer and extend around the torso toward the front for defining a partial encircling portion; breast cups 30 to which the back bands 25 attach; shoulder straps 40, which attach to the breast cups 30, pass over the shoulders, and attach to back bands 25 at the back of the wearer; a central panel 35 that connects the breast cups 30 at the front of the wearer, and; for some bras 10, a stiffening device such as an under-wire or plastic member 50 that is incorporated into the bra 10 at the lower periphery of the breast cups 30 and which partially encircle the breasts on the bottom side. The latter configuration utilizes the breast cups 30 as elements integral to the structure of bra 10. This configuration can also have multiple and partial layers of material in breast cups 30.

Figure 2:
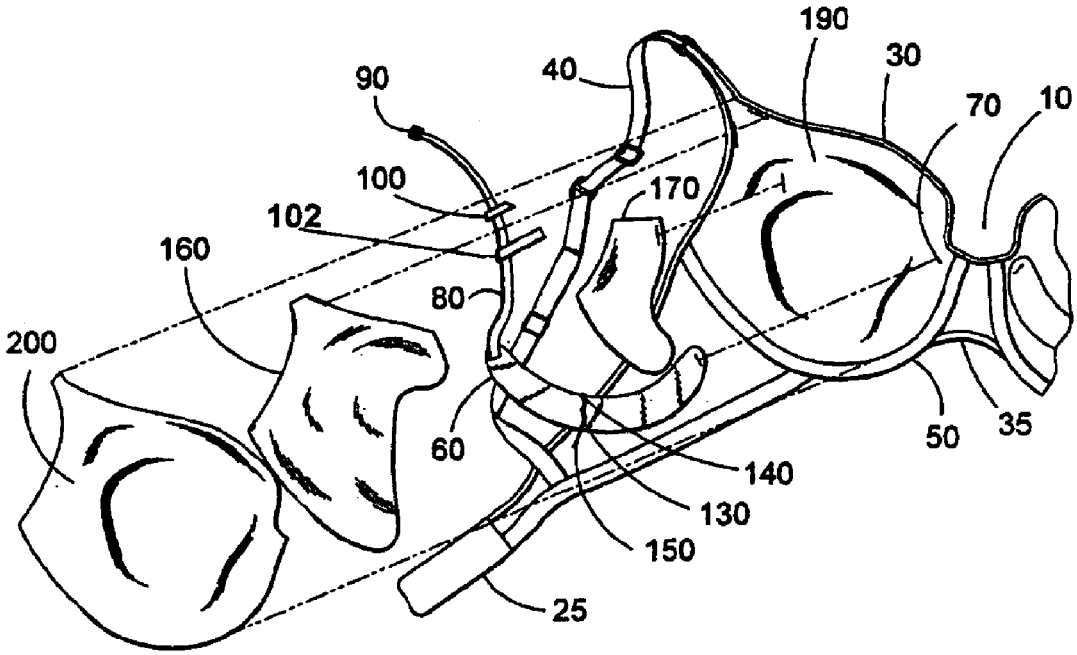
FIG. 2 is an exploded parts view of an adjustable breast positioning system viewed from an internal side of a breast cup of an adjustable breast positioning bra.
Figure 3:
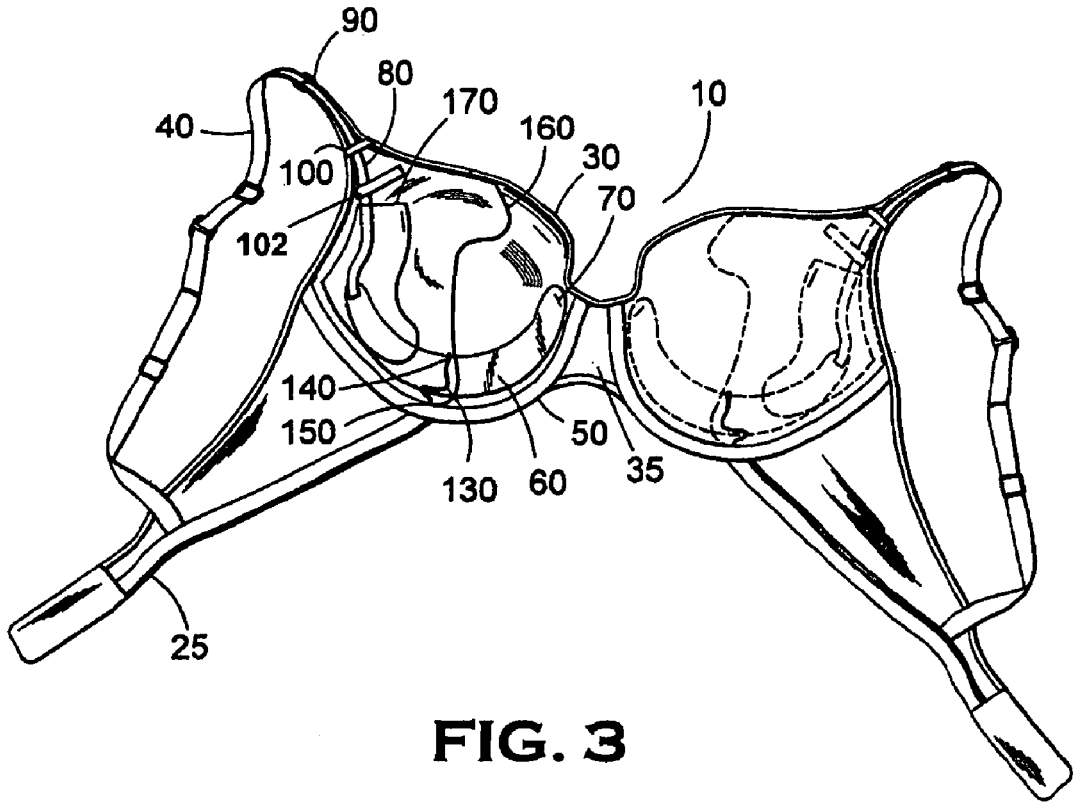
FIG. 3 shows an uncovered view of the adjustable breast positioning system in a first or an "at rest" position.
Figure 13:
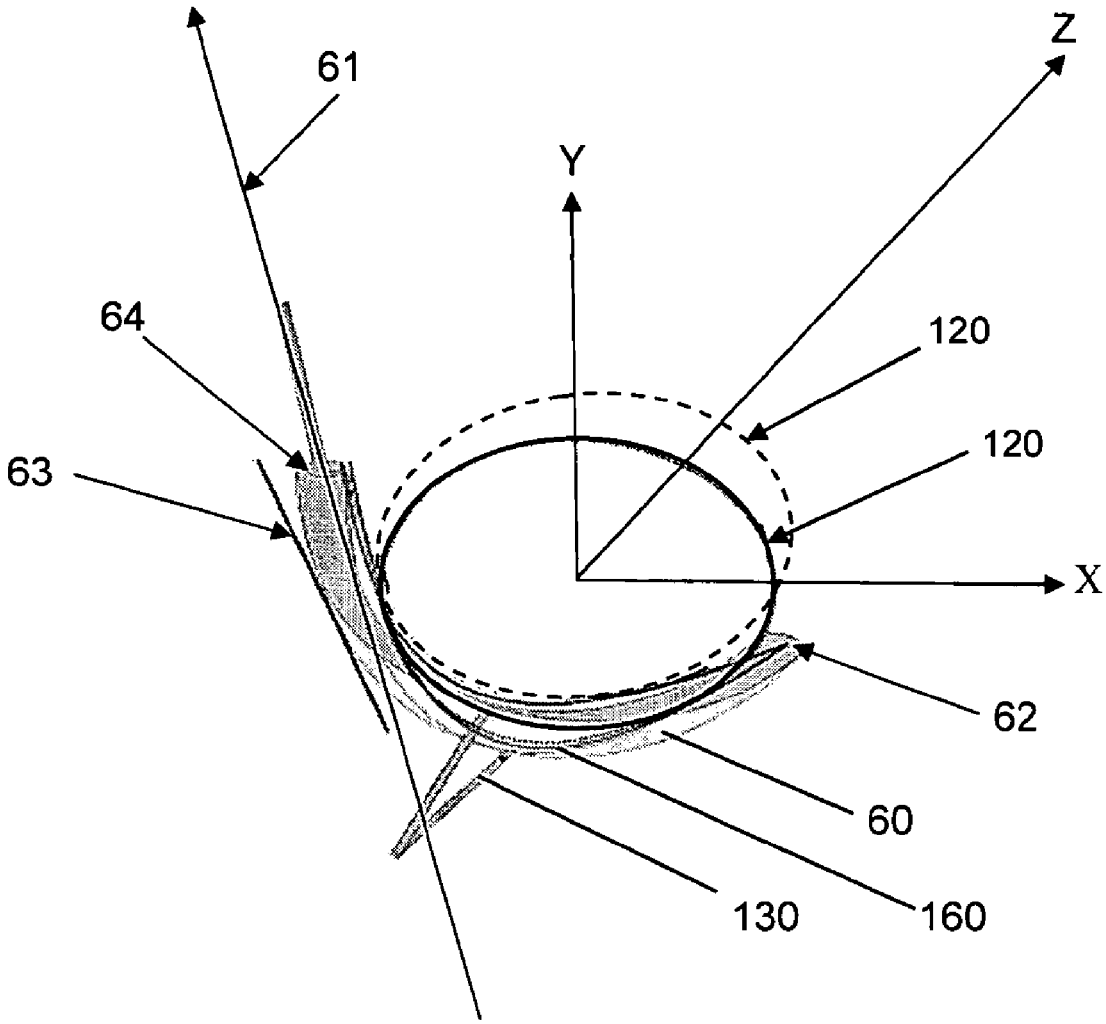
FIG. 13 is a diagrammatic view of the adjustable breast positioning system further detailing independent displacement of the breast between a first and a second position.

Referring to FIGS. 2, 3, and 13, and in one embodiment, the breast positioning system 10 is comprised of a pliable platform or rocker arm 60 and a flexible shaping member or glove 160. In one embodiment, the pliable platform 60 comprises a curvilinear shaped section transitioning from an end pivotally attached to bra 10 toward the center of the bra at point 70 and extending along an under side of the breast to another end of pliable platform 60 that is connected to connector 80. In one embodiment, the pliable platform 60 includes a side section integrally formed with the curvilinear shaped section and upwardly extending along an outer side of the breast terminating to another end of pliable platform 60 that is connected to connector 80. Connector 80 performs its function under a tensile load and therefore may be constructed of light, flexible material such as nylon strand or tether. Connector 80 passes from pliable platform 60 up breast cup 30 to shoulder strap 40 where it travels along shoulder strap 40 until it attaches to sliding anchor 90 mounted on shoulder strap 40. In one embodiment, connector 80 passes unexposed from pliable platform 60 up until it exits the interior of breast cup 30 to the wearer side of shoulder strap 40 where it travels along shoulder strap 40 until it attaches to sliding anchor 90 mounted on shoulder strap 40. Sliding anchor 90 is also visible in FIG. 1, but connector 80 is still essentially concealed by shoulder strap 40 in FIG. 1. Sliding anchor 90 is adjustable to different positions along shoulder strap 40 but is capable of holding its position once manually placed by way of a frictional fit. In another embodiment, sliding anchor 90 has teeth formed in it and it is these teeth which protrude into shoulder strap 40 to maintain the position of the sliding anchor 90, connector 80, and pliable platform 60. In one embodiment, sliding anchor 90 has a general figure eight configuration formed by two rectangularly shaped portions having a coming side and radiused edges. In another embodiment, sliding anchor 90 is replaced with sliding anchor 290 which is coupled in the same manner and provides the same function as sliding anchor 90 while providing an improved ability to be gripped by the user.

Figure 14:
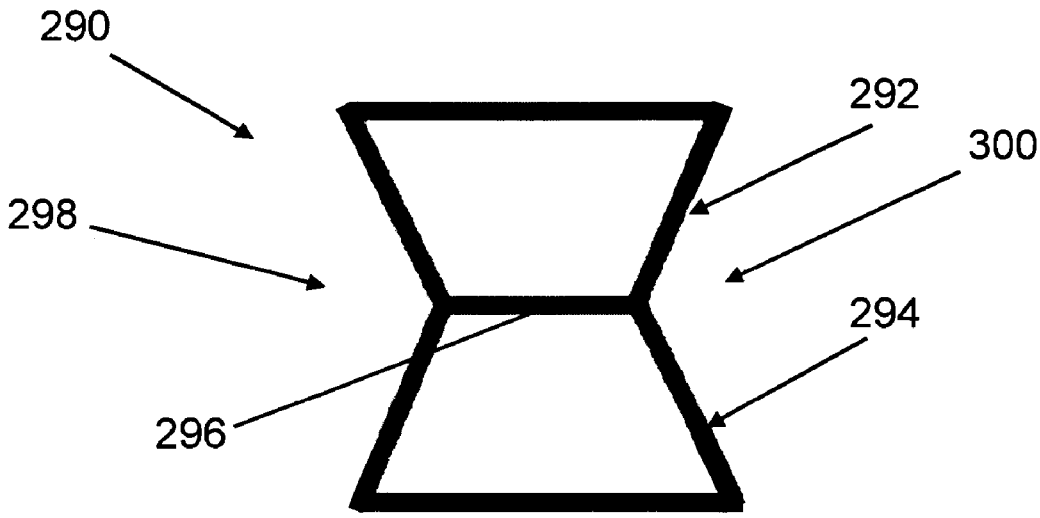
FIG. 14 is an enlarged front elevational view of another embodiment of a sliding anchor of the adjustable breast positioning system.
Figure 15:
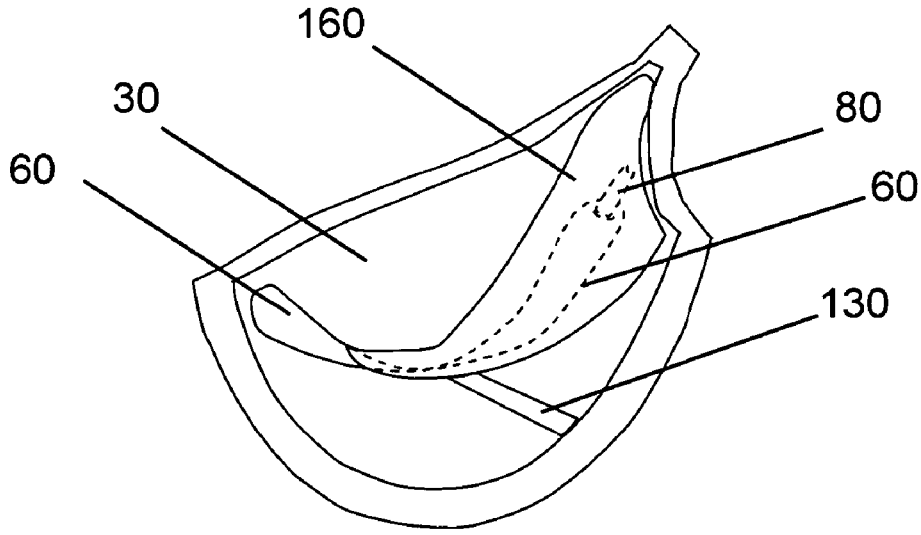
FIG. 15 is an uncovered diagrammatic view of the platform or rocker arm and the shaping member of the adjustable breast positioning system in an adjusted position.
Figure 16:
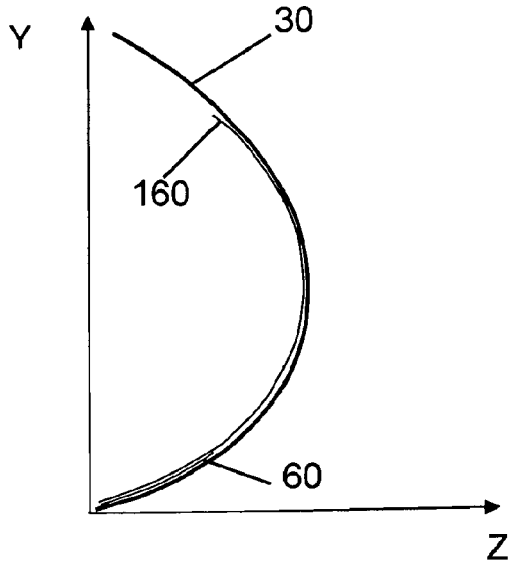
FIG. 16 is a diagrammatic sectional side view of the platform or rocker arm and the shaping member of the adjustable breast positioning system in a first or "at rest" position.
Figure 17:
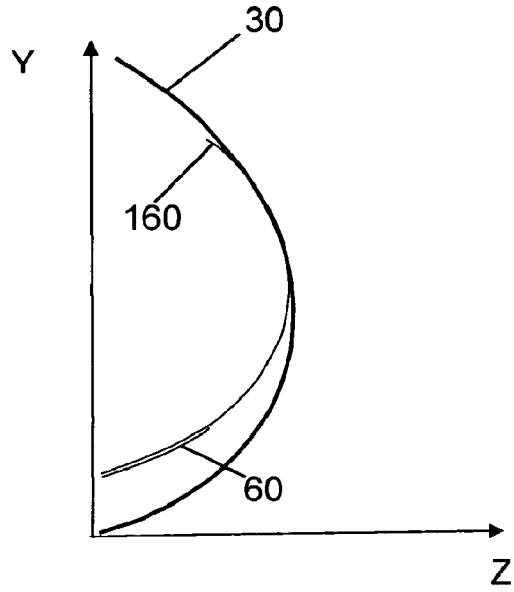
FIG. 17 is a diagrammatic sectional side view of the platform or rocker arm and the shaping member of the adjustable breast positioning system in an adjusted position.
Figure 18:
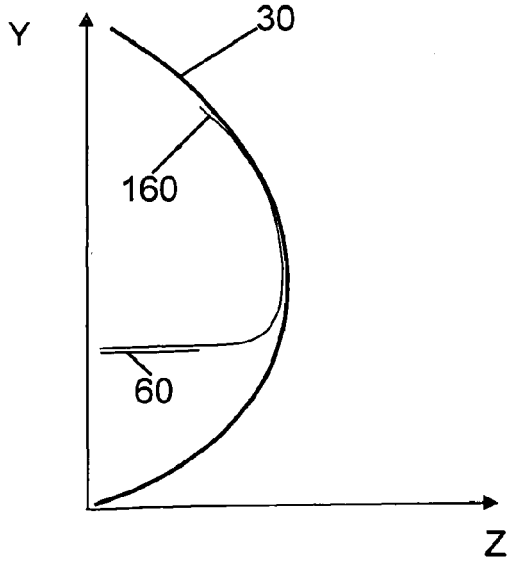
FIG. 18 is a diagrammatic sectional side view of the platform or rocker arm and the shaping member of the adjustable breast positioning system in another adjusted position.

Referring to FIG. 14, and more specifically, the sliding anchor 290 is formed by two trapezoidally shaped portions 292, 294 connected along a common parallel side 296 wherein the two trapezoidally shaped portions form a central X-shaped portion defining a pair of opposed concave sides 298, 300 for allowing improved gripping access for adjusting the sliding anchor 290 along shoulder strap 40. The length of the common parallel side 292 of sliding anchor 290 can be shortened for deepening the concavity of the pair of opposed concave sides 298, 300.

In another embodiment, connector 80 and pliable platform 60 can be integrally formed with one another forming a single member.

Hence, suspending platform 60 from connector or adjusting member 80 at one end and to the breast cup at another end at a point in an area nearer a center of the wearer's chest or toward a cleavage area of the wearer's chest, essentially distributes the weight of the breast between the shoulder strap and the structure around the chest.

FIG. 13 diagrammatically illustrates the breast translation when the pliable platform 60 is adjusted from a first to a second position and illustrates a reference coordinate system wherein the positive Z axis is in the direction the wearer is facing, the positive Y axis is in a vertical or upward direction relative to the wearer, and the X axis is the horizontal axis with its positive direction being relative to each breast and being toward a center or cleavage area of the wearer's chest.

Figure 4:
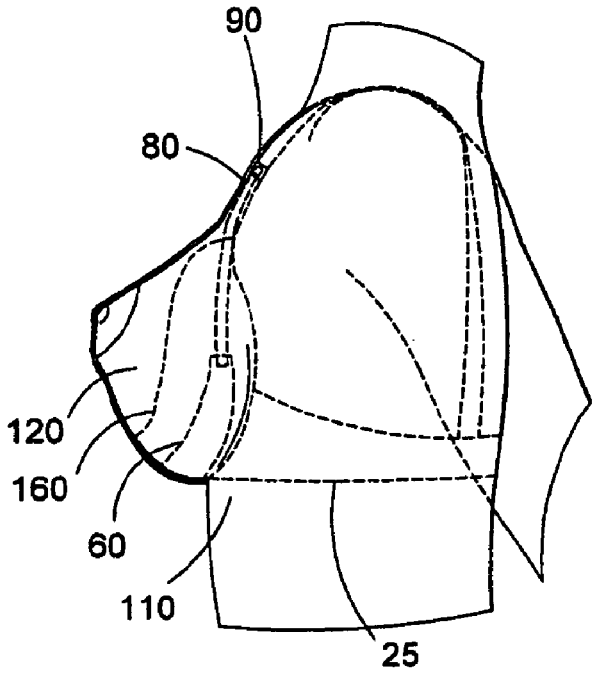
FIG. 4 is a side cutaway view of the adjustable breast positioning system and a side view of a breast in a first or "at rest" position.

In one embodiment, and referring to FIGS. 3, 4, and 13, the breast positioning system 10 comprises the pliable platform 60 situated at a first position within a bottom portion of a breast cup 30 proximate a lower periphery 32 of the breast cup 30. The pliable platform 60 includes one end 62 attached to the breast cup at point 70 in an area nearer a center of the wearer's chest and another end 64 distal from the attached end. The pliable platform 60 further includes a curvilinear shaped section having, when said pliable platform is situated at a first position, a first curvature transitioning from the attached end and extending along the bottom portion of the breast cup at a location proximate the lower periphery of the breast cup. The system 10 further comprises means for applying a force along line 61 to the distal end 64 of the pliable platform while the pliable platform is retained at the attached end 62 for decreasing the first curvature of the pliable platform to a second different curvature less proximate to the lower periphery of the breast cup than the first curvature for reducing the available breast cup volume within the breast cup for providing breast positioning by displacing the breast upward along the positive Y axis, forward along the positive Z axis, and inward toward the center of the wearer's chest along the horizontal positive X axis while concomitantly increasing the volume of the breast outside an upper portion of the breast cup for providing an improved visual presentation of the breast. In one embodiment, the force applying means comprises the anchor 90 movably mounted on the strap 40 of the garment and a connecting member 80 having a first end attached to the distal end 64 of the pliable platform and a second end attached to the anchor 90 movable from place to place on the strap 40 of the garment for adjusting a degree of decrease of the second different curvature from the first curvature of the pliable platform.

FIG. 13 diagrammatically illustrates the breast translation when the pliable platform 60 is adjusted from the first to the second position wherein when the pliable platform is in the first position the breast is illustrated by the solid breast 120 and when the pliable platform adjusted to the second position the breast 120 is pushed upward in the positive y direction, forward away from the chest of the wearer in the positive Z direction, and closer together or toward the center of the chest along the positive X direction resulting in a breast position as illustrated by the dashed breast 120. Additionally, the pliable platform 60 and the flexible shaping member 160 provide breast constraint along line 63 when the pliable platform 60 is adjusted from the first to the second position.

The path of pliable platform 60 may be guided by guide loops 100, 102 which, in one embodiment, are flattened loops attached to breast cup 30 and shoulder strap 40. Guide loops 100, 102 keep connector 80 aligned with shoulder strap 90 and keep it from becoming tangled. Guide loop 102 can be sized and/or located for controlling the degree of inclination of force acting on the pliable platform 60 when in an adjusted position.

Figure 6:
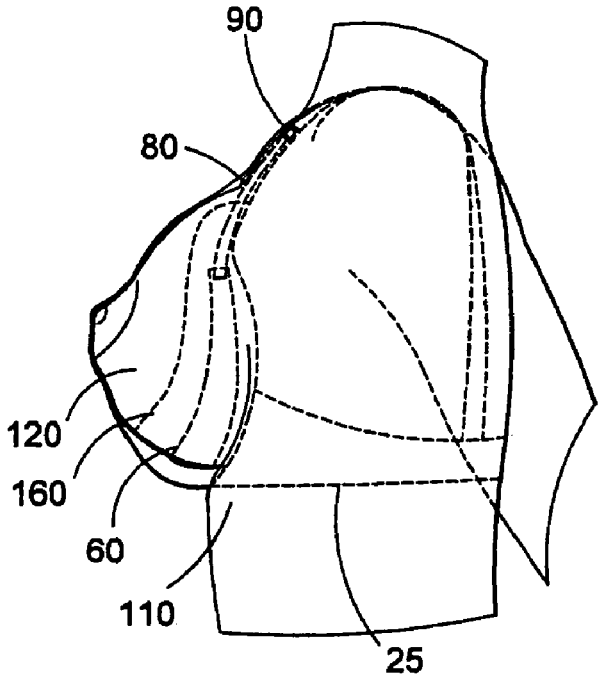
FIG. 6 is a side cutaway view of the adjustable breast positioning system and a side view of the breast in the adjusted or second position.

Referring now to the profile views of FIGS. 4 and 6, and in one embodiment, it is desirable for the pliable platform 60 to remain close to the body 110 of the wearer as it positions the breast, rather than move along the contour of breast 120. Pliable platform 60 may be seen in a first or "at rest" position relative to body 110 in FIG. 4 and in an adjusted, second, or active position relative to body 110 in FIG. 6.

In one embodiment, and referring back to FIGS. 2 and 3, the path of pliable platform 60 is guided by a guide or control member 130. Control member 130 causes pliable platform 60 to stay close to the body 110 as pliable platform 60 is actuated by connector 80. This ensures that the motion of pliable platform 60 provides positioning and does not merely slide up along breast 120. In one embodiment, guide or control member 130 works under a tensile load and therefore may be constructed from nylon strand or similar flexible material and will be a tensile member having two ends. A first end 140 of control member 130 is attached to pliable platform 60 and a second end 150 is anchored to bra 10 at the bottom of cup 30 near stiffening device 50, or if bra 10 has the general structure shown in FIG. 1, near chest band 20. Control member 130 limits the degree of freedom pliable platform 60 has to move away from body 110 as connector 80 activates or adjusts pliable platform 60 and flexible shaping member 160.

Figure 5:
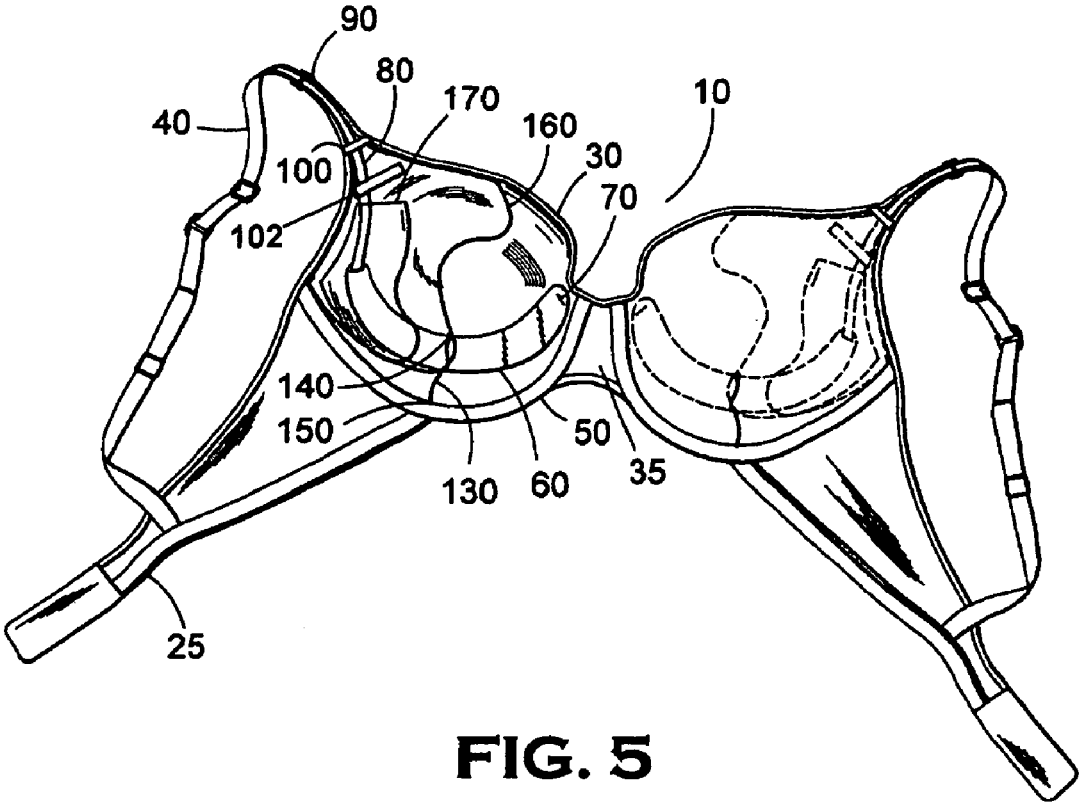
FIG. 5 shows an uncovered view of the adjustable breast positioning system in an adjusted or second position.

In FIG. 3 control member 130 is slack and somewhat coiled, while FIG. 5 shows control member 130 taut and restraining pliable platform 60 when in an adjusted position as shown in FIG. 6.

Figure 7:
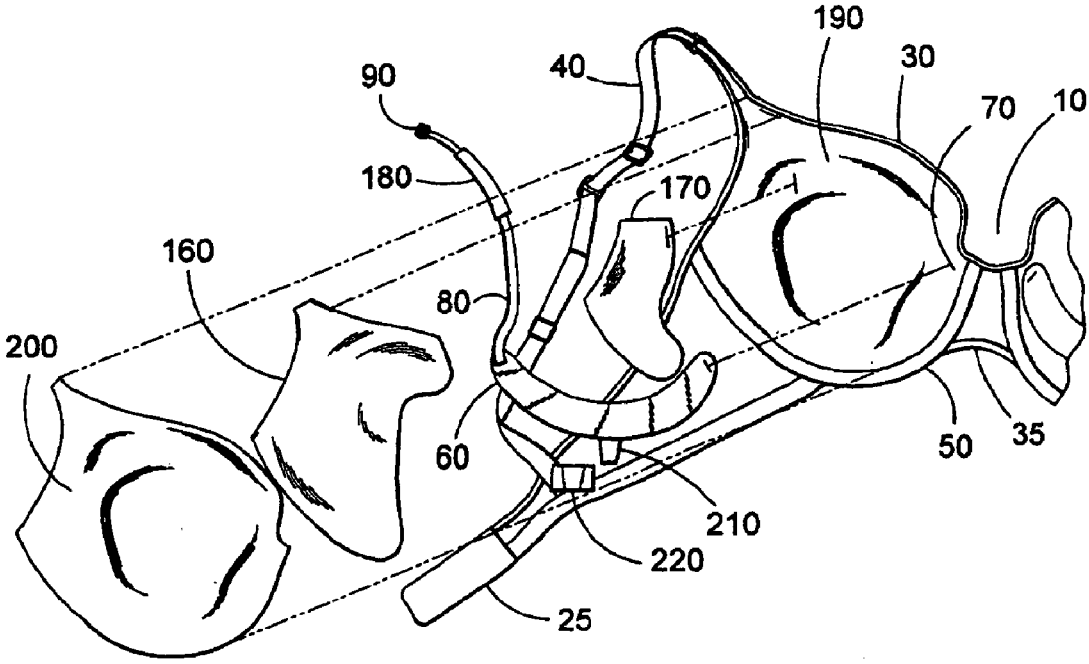
FIG. 7 is an exploded view of another embodiment of the adjustable breast positioning system from the internal side of the breast cup.

Turning now to flexible shaping member 160, and as shown in FIGS. 2 and 7, a cover layer 200 covers flexible shaping member 160 and keeps it from making direct contact with the wearer. As shown in FIG. 3, as well as FIG. 8, flexible shaping member 160 lays into the outside area, as opposed to the central area, of breast cup 30. Flexible shaping member 160 is held in location at its upper corner where it extends toward shoulder strap 90. This leaves flexible shaping member 160 free to move, flex, and position.

In one embodiment, flexible shaping member 160 is made of thin plastic sheeting of a thickness making it highly flexible, but retaining the ability to support and position breast 120. It is possible that another class of material other than plastic may be used. Despite its thinness and flexibility, when actuated by pliable platform 60, flexible shaping member 160 is capable of displacing the breast from lower in breast cup 30, upwardly and centrally, and to also project from the body and outsides the upper constrains of the breast cup 30. The location of flexible shaping member 160 in the outside area of breast cup 30 prevents the breast from bulging unnaturally out the side of breast cup 30. In one embodiment, it is pliable platform 60 that actuates flexible shaping member 160, while flexible shaping member 160 facilitates the movement of pliable platform 60 within the cloth confines of breast cup 30 and further broadens and distributes the multidimensional positioning effect of pliable platform 60.

Due to its also performing the functions of facilitating the motion of pliable platform 60 and distributing the positioning effect, flexible shaping member 160 may also be thought of as a smoothing shield similar to smoothing shield 170 discussed below. However, flexible shaping member 160 would be performing the smoothing functions between pliable platform 60 and the wearer of the garment.

Smoothing shield 170 is located on the side of pliable platform 60 facing away from the wearer between pliable platform 60 and cup panel 190. The location of the smoothing shield in relation to the other elements of the adjustable breast positioning system can best be seen in FIG. 2, while its location within the breast cup can best be seen in FIG. 3. Smoothing shield 170 performs at least two functions. Similarly to flexible shaping member 160, smoothing shield 170 eases the movement of pliable platform 60 through a pliant cloth environment. In addition to that, smoothing shield 170 maintains a smooth outer surface on cup 30 and prevents pliable platform 60 from distorting the cosmetic appearance. This is particularly important at the moving end of pliable platform 60 where connector 80 attaches, and as can be seen in FIG. 3, smoothing shield 170 is located in the area where the moving end of pliable platform 60 travels. Smoothing shield 170 may be anchored at any location that does not hinder pliable platform 60, and position guide 130, and smoothing shield 170 may also have more than one layer of material between it and the outer most layer of cup panel 190.

Figure 8:
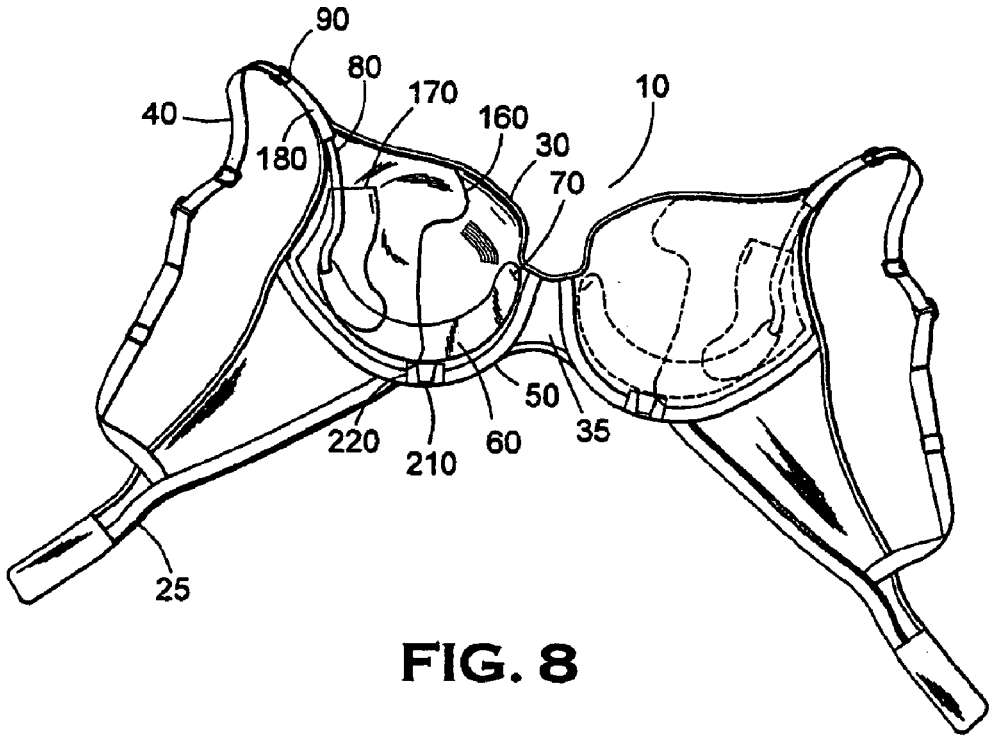
FIG. 8 shows an uncovered view of the embodiment of the adjustable breast positioning system shown in FIG. 7 in a first or "at rest" position.
Figure 9:
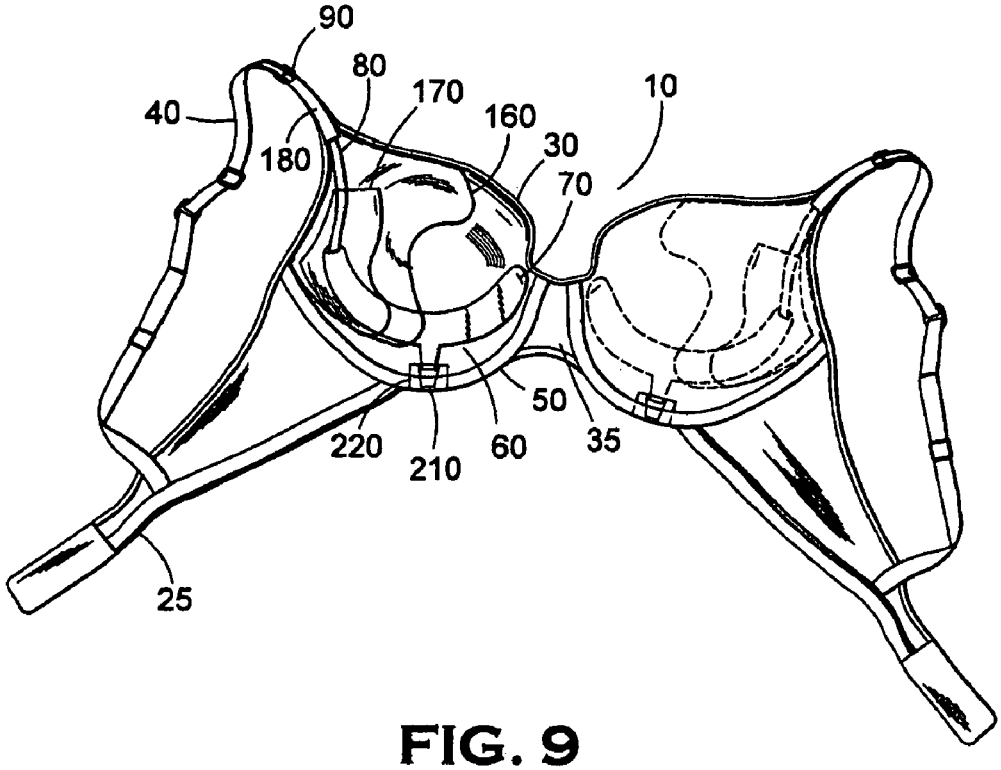
FIG. 9 shows an uncovered view of the embodiment of the adjustable breast positioning system shown in FIG. 7 in an adjusted or second position.

FIGS. 7, 8, and 9 feature another embodiment wherein FIG. 8 shows the embodiment in an "at rest" position, while FIG. 9 shows the embodiment in an adjusted position.

In this embodiment, and referring to FIG. 7, connector 80 passes through a connector tube 180. Connector tube 180 is a tubular sleeve made of pliant flexible material such as a cloth or fabric and can be attached at places along its length to bra 10. Connector tube 180 can be seen in FIG. 8 sewn along shoulder strap 40 on down into the upper outside corner of breast cup 30 to prescribe the path of connector 80. Connector tube 180 may be seen in FIG. 9 as well.

The embodiment shown in FIGS. 7, 8, and 9 utilizes stabilizer tab 210 and stabilizer guide 220 to control or guide the motion of pliable platform 60 as it moves. Stabilizer tab 210 is a tab attached to pliable platform 60 and directed essentially vertically downward from the edge of pliable platform 60 nearest the wearer. Attached to the bottom edge of breast cup 30 is stabilizer guide 220, which is shaped with a pocket or channel into which stabilizer tab 210 inserts. As shown in FIG. 8, when pliable platform 60 is in an at rest position, stabilizer tab 210 inserts more fully into stabilizer guide 220. In the adjusted position of FIG. 9, stabilizer tab 210 is partially drawn from stabilizer guide 220. The continued engagement of stabilizer tab 210 in stabilizer guide 220 keeps pliable platform 60 closer to the body 110 of the wearer instead of sliding upward on breast 120. The effect of this is shown in FIGS. 4 and 6. Flexible shaping member 160 distributes the repositioning of pliable platform 60 to more of breast 120.

Stabilizer tab 210 is most likely an integral part of pliable platform 60 and made of the same material as pliable platform 60 but may also be a different material. This may be accomplished, for example, by inserting a metallic stabilizer tab 210 into the mold used to mold pliable platform 60 from its material of flexibly resilient plastic. Similarly, stabilizer guide 220 may be fixed to cup 30 in various ways or may, in the alternative, be incorporated into a structural member such as under wire 50.

There are many ways to vary the elements of these embodiments and remain within the spirit and scope of the present invention.

For example, the connector tube 180 need not be exclusive to one embodiment and may be used in conjunction with the guide loops 100, 102. Similarly guide loops 100, 102 may be used in the embodiment of FIGS. 7, 8, and 9. A slide could be provided along the under wire and pulled to cause the pliable platform 60 to adjust from a first position to a second position.

Additionally, the adjustable breast positioning system could employ a constraining or control loop for precluding the pliable platform from traversing up along the breast and away from the body.

In another embodiment, the adjustable breast positioning system could employ a constraining or control slot in the flexible shaping member 160 through which the pliable platform is threaded for precluding the pliable platform from traversing up along the breast and away from the body. In another embodiment, the adjustable breast positioning system could employ a sliding coupling or tab in the form of a tab limiting travel of the pliable platform up along the breast and away from the body when the pliable platform is actuated from a first or an "initial" position to subsequent adjusted or actuated positions of use and operation. The tab member can be attached to the flexible shaping member and folded over onto the pliable platform or attached to the pliable platform and folded over onto the flexible shaping member for providing a sliding coupling for maintaining the pliable platform substantially under the breast when the pliable platform changes position. The sliding coupling or tab can be used with or without guide or control member 130.

Furthermore, the pliable platform pivot point can mount further away from point 70 as the cup size and load increases. This may also preferred for creating less lift/more cleavage enhancement. The pliable platform 60 may also be located between layers of a multilayer breast cup with point 70 being on an exterior or non-exterior layer, either one. Moreover, the adjustable breast positioning system may utilize a plurality of pliable platforms 60.

Figure 10:
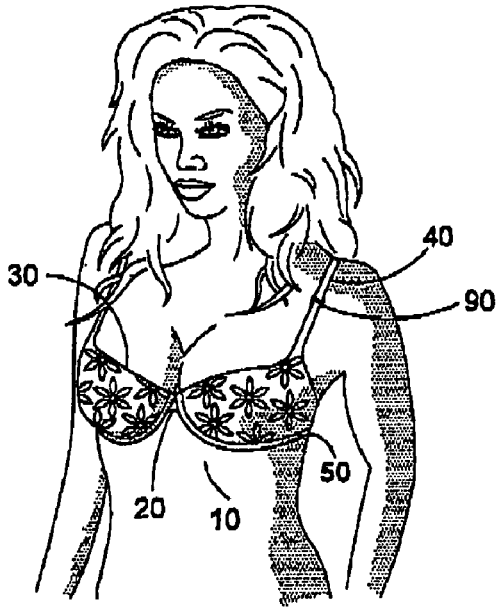
FIG. 10 shows an adjustable breast positioning swimsuit top being worn.
Figure 11:
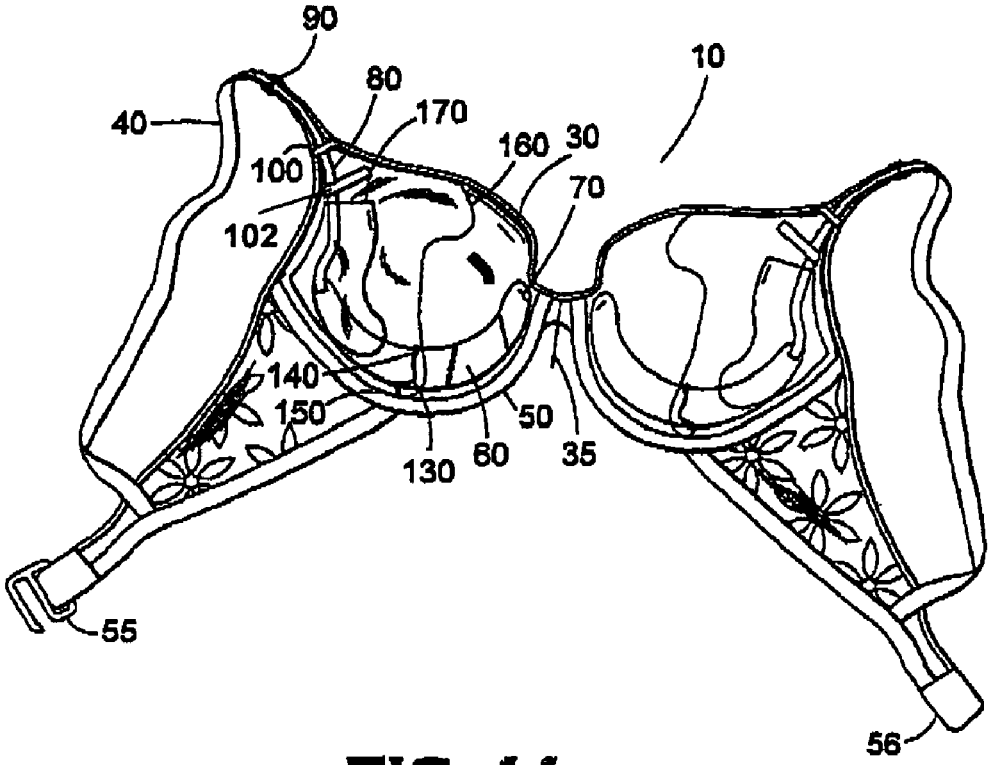
FIG. 11 shows an uncovered view of the adjustable breast positioning system in a first or "at rest" position.
Figure 12:
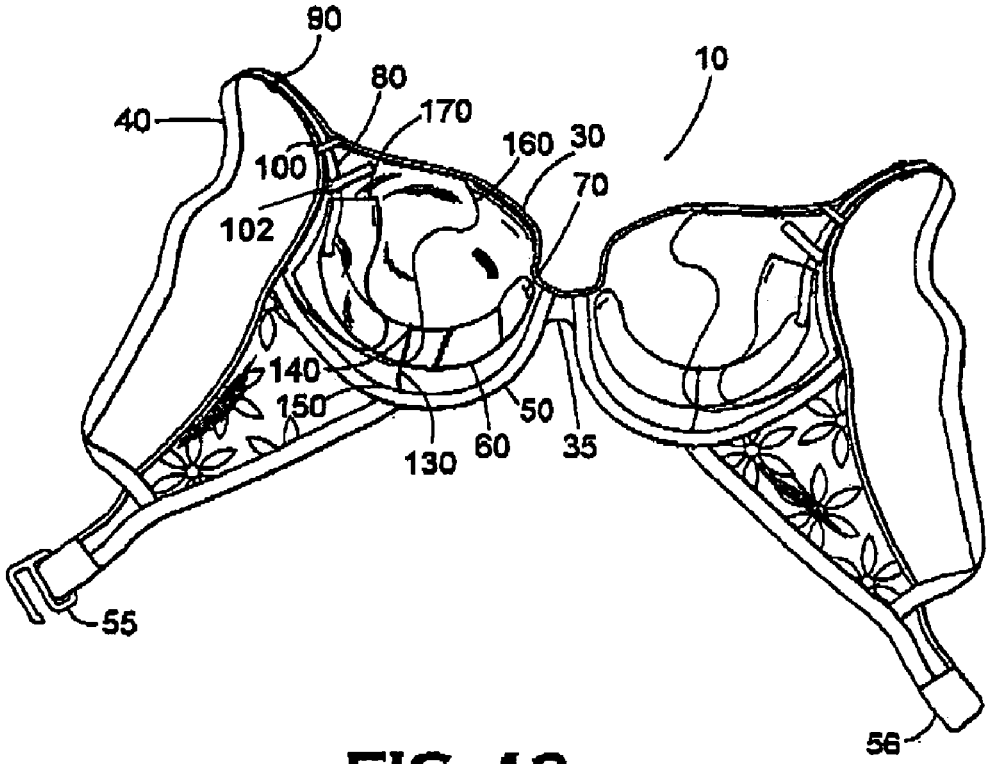
FIG. 12 shows an uncovered view of the adjustable breast positioning system in an adjusted or second position.

Referring now to FIG. 10, and in another embodiment, a garment in the form of a swimsuit top incorporating the adjustable breast positing system is shown being worn wherein the elements present in embodiments shown in FIG. 2, FIG. 3, and FIG. 5 may also be seen in the swimsuit top as shown in FIGS. 11 and 12 and they function the same. The discreteness of the adjustable breast positioning system allows a totally exposed garment to employ the system and the system to be unnoticeable except for its results.

In FIG. 11 and FIG. 12 it can be seen that the method of fastening the swimsuit top is typical to many swimsuit tops. A hook 55 is attached to one back band 25 while a loop 56 is sewn at the end of the opposing back band. Hook 55 engages loop 56 to hold the swimsuit top on the wearer.

In use and operation, and referring to the drawings, the pliable platform 60 is located along the bottom arc of breast cup 30 of the bra 10 when the bra is being worn and before the breast positioning system is actuated. The end of pliable platform 60 that is near the center of the chest is pivotally connected to breast cup 30 at a connection point which, in one embodiment, is point 70. The other end of pliable platform 60, near the side of the chest, has connector 80 attached to it. Smoothing shield 170 is located at that end of the pliable platform 60 and is on the opposite side of pliable platform 60 from the wearer.

In one embodiment, pliable platform 60 is constructed of flexible material comprised of a surface area which may vary greatly depending on the size of breast cup 30 and whether lift is desired more than projection from the body, or the reverse. The shape of pliable platform 60 is also influenced by where point 70 is located in breast cup 30, the structural configuration of the bra, or garment, and other factors, such as the preferred change in the breast position.

Alternatively, the pliable platform 60 may be of a more resilient type thereby performing somewhat like a lever to position the breast with the fulcrum of the lever being at the connection point. In this case, pliable platform 60 is constructed resilient enough to position the breast in this way, with the particular material used determining how thick pliable platform 60 needs to be. Additionally, the pliable platform 60 may be constructed of multiple sections operatively coupled to one another.

Looking at FIG. 4, it can be seen that, in the initial position, flexible shaping member 160 conforms to breast 120 and is pressed into breast cup 30 by breast 120. Flexible shaping member 160 covers a good part of breast cup 30 toward the side of the chest. Connector 80 runs from where it is attached to pliable platform 60 up across breast cup 30, and up shoulder strap 40, where it terminates at sliding anchor 90 on shoulder strap 40.

To actuate positioning, sliding anchor 90 is adjusted further up on shoulder strap 40 and maintained by a frictional fit or by teeth on the sliding anchor protruding into shoulder strap 40. Connector 80 is moved with slider anchor 90 and pulls upward on pliable platform 60 which suspends from point 70 wherein the load on the platform is distributed to the garment at point 70 and to the shoulder strap 40 via connector 80.

As pliable platform 60 moves upward it undergoes a shape transformation for displacing the breast upward, forward, and inward toward the center of the wearer's chest while concomitantly increasing the volume of the breast outside an upper portion of said at least one breast cup for providing said improved visual presentation of the breast.

Guide or control member 130 controls or guides the motion of pliable platform 60, keeping pliable platform 60 close to the body of the wearer, ensuring that the system elements position breast 120 instead of merely adjusting over the surface of breast 120. Smoothing shield 170 facilitates the motion of pliable platform 60 and prevents it from distorting the outward appearance of breast cup 30.

Pliable platform 60, flexible shaping member 160, and smoothing shield 170, may all be constructed of more than one piece and still accomplish their respective purposes.

Typically, the working elements of the adjustable breast positioning system will be surrounded by layers of pliant flexible material, cloth, or foam such as cup panel 190 and cover layer 200 shown in FIG. 2. Layers of pliant flexible material may also be interspersed between the working elements of the positioning system, particularly if an interspersed layer does not cover the entire area of breast cup 30. These layers may prevent connector 80 from becoming tangled with the other elements and will also smooth the outward appearance of the adjustable breast positioning system. In particular, multiple layers of material may form the outermost cup panel 190 covering the outermost elements of the adjustable breast positioning system to enhance the natural look of the positioned breast 120.

Regardless of how many layers of material a breast cup may have, it will have two visible sides and a perimeter at its defining edges. One side, the observable side, is visible to others observing a person wearing the garment. The other side, the wearer side of the breast cup, is not generally visible while the garment is worn because it is placed against the wearer. The wearer side may, however, be visible when the garment is not being worn. It is preferred that the observable side of the breast cup appear natural and not supplemented, while it is preferred that the wearer side of the breast cup be comfortable for the wearer. The perimeter of the breast cup will be free along some sections of the perimeter and attached to other parts of the garment along other sections of the perimeter.

Additionally, connector 80 may be located between layers if there are multiple layers, and guides 100, 102 may attach to more than one layer, especially where some layers do not cover the exact same area of breast cup 30. It is even possible that connector 80 could pass from one side of a layer through an aperture in the layer to the other side of the layer. In this case the aperture itself may act as a guide loop 100, 1002.

Also, and as noted hereinabove, means of limiting the horizontal displacement of pliable platform 60 may also be varied. The dynamic interaction of pliable platform 60 and flexible shaping member 160 and/or smoothing shield 170 may be used for this purpose. This may be accomplished by limiting or constraining the relative motion between these elements. As an example, if pliable platform 60 and flexible shaping member 160 may only move relative to each other in a direction along the length of pliable platform 60 or along their edges, flexible shaping member 160 will keep pliable platform 60 from sliding up breast 120.

Furthermore, depending on the direction of breast positioning, specifics of embodiments may be altered. For example, the particular location within breast cup 30 of point 70 affects the motion of pliable platform 60, and the resulting motion of breast movement. Similarly, the arrangement and location of flexible shaping member 160 and other smoothing shields will affect the direction of positioning and the shape of breast 120. Depending on the type of pliable platform 60 and its location, connector 80 may be guided at different inclination angles or paths to allow smooth and desired operation of the adjustable breast positioning system. The location and type of anchor may be changes as well.

Accordingly, and in one aspect, an embodiment of the invention provides a breast positioning system for a garment having at least one breast cup for receiving a breast of a wearer, the breast positioning system comprising: a pliable platform situated at a first position within a bottom portion of the at least one breast cup and having an end attached to the at least one breast cup in an area nearer a center of the wearer's chest and an end distal from the attached end; the pliable platform comprising a curvilinear shaped section having, when the pliable platform is situated at the first position, a first curvature transitioning from the attached end and extending along the bottom portion of the at least one breast cup at a location proximate a lower periphery of the at least one breast cup; and means for applying a force to the distal end of the pliable platform while the pliable platform is retained at the attached end for decreasing the first curvature of the pliable platform to a second different curvature less proximate to the lower periphery of the at least one breast cup than the first curvature for reducing available breast cup volume within the at least one breast cup for providing a breast positioning system.

In another aspect, an embodiment of the invention provides a breast positioning system for a garment having at least one breast cup for receiving a breast of a wearer, the breast positioning system comprising: a pliable platform situated at a first position within a lower region of the at least one breast cup and having an end attached to the at least one breast cup in an area nearer a center of the wearer's chest and an end distal from the attached end; the pliable platform comprising a first section having a first curvature transitioning from the attached end and extending along an under side of the breast received within the at least one breast cup; the pliable platform comprising a second section transitioning from the first section and upwardly extending along an outer side of the breast and terminating to the distal end; a flexible shaping member interposed between the pliable platform and the breast and at least partially overlaying the first and the second sections of the pliable platform; and means for applying a force to the distal end of the pliable platform while the pliable platform is retained at the attached end for decreasing the first curvature of the pliable platform to a second different curvature extending along the underside of the breast for reducing the available volume for the breast received within the at least one breast cup while concomitantly pushing the flexible shaping member with the pliable platform in an upward and inward direction for providing an improved visual presentation of the breast. Thus, the force applying means causes the net linear length along the surface of the combined length of the pliable platform and the flexible shaping member to decrease as the pliable platform transforms from the first curvature to the second curvature.

In another aspect, an embodiment of the invention provides a method for providing an adjustable positioning support for a breast received within a breast cup of a woman's garment, the steps comprising: locating a first flexible member within a lower region of the breast cup; overlaying at least a portion of the first flexible member with a second flexible member; and applying a force to a second end of the first flexible member while retaining a first end of the first flexible member for sliding the first flexible member relative to the second flexible member for reducing the available volume for the breast within the breast cup for providing an improved visual presentation of the breast.

In another aspect, and referring to FIGS. 3, 4, 6, 13, and 15, an embodiment of the invention provides a breast positioning system for a garment comprising at least one breast cup 30 having an available breast cup volume for receiving a breast of a wearer, the breast positioning system comprising: a pliable platform 60 situated at a first position within a bottom portion of the at least one breast cup 30 and having an end 62 attached to the at least one breast cup and an end 64 distal from the attached end; the pliable platform comprising a curved section transitioning from the attached end and extending along the bottom portion of the at least one breast cup at a first location proximate a lower periphery of the at least one breast cup when the pliable platform is situated at the first position; and means for applying a force to the distal end 64 of the pliable platform 60 while the pliable platform is retained at the attached end for flattening at least a portion of the curved section while positioning the pliable platform 60 to a second location less proximate to the lower periphery of the at least one breast cup 30 than the first location for providing breast positioning by displacing the breast upward along the positive Y axis, forward along the positive Z axis, and inward toward the center or cleavage area of the wearer's chest along the horizontal positive X axis while concomitantly increasing the volume of the breast outside an upper portion of the breast cup for providing an improved visual presentation of the breast. In one embodiment, the force applying means comprises the anchor 90 or 290 movably mounted on the strap 40 of the garment and a connecting member 80 having a first end attached to the distal end 64 of the pliable platform and a second end attached to the anchor 90 or 290 movable from place to place on the strap 40 of the garment for adjusting a degree of flattening of at least the portion of the curved section of said pliable platform.

In another aspect, and referring to FIGS. 3, 4, 6, 13, and 15, an embodiment of the invention provides a breast positioning system for a garment comprising at least one breast cup 30 having an available breast cup volume for receiving a breast of a wearer, the breast positioning system comprising: a pliable platform 60 situated at a first position within a lower region of the at least one breast cup 30; the pliable platform 60 having an end 62 attached to the at least one breast cup and an end 64 distal from the attached end; the pliable platform 60 comprising a curved section transitioning from the attached end and extending along at least a portion of an under side of the breast received within the at least one breast cup 30; a flexible shaping member 160 interposed between the pliable platform 60 and the breast and at least partially overlaying the curved section of the pliable platform; and means for applying a force to the distal end 64 of the pliable platform 60 while the pliable platform 60 is retained at the attached end for flattening at least a portion of the curved section and at least a portion of the flexible shaping member 160 at least partially overlaying the curved section of the pliable platform for reducing the available breast cup volume for the breast received within the at least one breast cup for providing breast positioning by displacing the breast upward along the positive Y axis, forward along the positive Z axis, and inward toward the center or cleavage area of the wearer's chest along the horizontal positive X axis while concomitantly increasing the volume of the breast outside an upper portion of the breast cup for providing an improved visual presentation of the breast. In one embodiment, the force applying means comprises the anchor 90 or 290 movably mounted on the strap 40 of the garment and a connecting member 80 having a first end attached to the distal end 64 of the pliable platform and a second end attached to the anchor 90 or 290 movable from place to place on the strap 40 of the garment for adjusting said degree of flattening of at least said portion of said curved section and at least said portion of said flexible shaping member at least partially overlaying said curved section of said pliable platform.

In another aspect, and referring to FIGS. 3, 4, 6, 13, and 15, an embodiment of the invention provides a breast positioning system for a garment comprising at least one breast cup 30 having an available breast cup volume for receiving a breast of a wearer, the breast positioning system comprising: a pliable platform 60 situated within the at least one breast cup 30; the pliable platform 60 having an end 62 attached to the at least one breast cup and an end 64 distal from the attached end; a flexible shaping member 160 interposed between the pliable platform 60 and the breast, the flexible shaping member at least partially overlaying the pliable platform; and means for applying a force to the distal end 64 of the pliable platform 60 while the pliable platform is retained at the attached end 62 for positioning the flexible shaping member 160 with the pliable platform 60 while maintaining at least a partial overlap of the flexible shaping member 160 with the pliable platform 60 for reducing the available breast cup volume for the breast received within the at least one breast cup for providing breast positioning by displacing the breast upward along the positive Y axis, forward along the positive Z axis, and inward toward the center or cleavage area of the wearer's chest along the horizontal positive X axis while concomitantly increasing the volume of the breast outside an upper portion of the breast cup for providing an improved visual presentation of the breast. In one embodiment, the force applying means comprises the anchor 90 or 290 movably mounted on the strap 40 of the garment and a connecting member 80 having a first end attached to the distal end 64 of the pliable platform and a second end attached to the anchor 90 or 290 movable from place to place on the strap 40 of the garment for adjusting said degree of flattening of at least said portion of said curved section and at least said portion of said flexible shaping member at least partially overlaying said curved section of said pliable platform.

In another aspect, and referring to FIGS. 3, 4, 6, 13, 15, and 16 through 18, an embodiment of the invention provides a breast positioning system for women's garments, the breast positioning system comprising: a garment, the garment comprising at least one breast cup 30 having an available breast cup volume for receiving a breast of a wearer; a platform 60 situated within the at least one breast cup 30 and having an end attached to the at least one breast cup 30 at, for example, point 70 and an end distal from the attached end; and means for applying a force to the distal end of the platform 60 while the platform 60 is retained at the attached end for positioning at least a portion of the platform 60 into a substantially horizontal plane relative to and below the breast of the wearer for supporting at least the portion of the breast on at least the portion of the platform 60 positioned into the substantially horizontal plane or, in other words, positioned into a substantially parallel relation to the horizontal x, z plane (FIGS. 13 and 16 through 18) relative to and below the breast of the wearer and for displacing the breast received within at least the one breast cup upward and inward toward the center of the wearer's chest while concomitantly increasing the volume of the breast outside an upper portion of at least the one breast cup.

In another aspect, and referring to FIGS. 3, 4, 6, 13, 15, and 16 through 18, an embodiment of the invention provides a breast positioning system for women's garments, the breast positioning system comprising: a garment, the garment comprising at least one breast cup 30 having an available breast cup volume for receiving a breast of a wearer; a platform 60 situated at a first position within a bottom portion of the at least one breast cup 30 and having an end attached to the at least one breast cup 30 at, for example, point 70 and an end distal from the attached end; the platform 60 transitioning from the attached end and extending along the bottom portion of the at least one breast cup 30 at a first location proximate a lower periphery of the at least one breast cup 30 when the platform 60 is situated at the first position; and means for applying a force to the distal end of the platform while the platform is retained at the attached end for positioning the platform to a second location less proximate to the lower periphery of at least the one breast cup than the first location for positioning at least a portion of the platform 60 into a substantially horizontal plane relative to and below the breast of the wearer for supporting at least a portion of the breast on at least the portion of the platform 60 positioned into the substantially horizontal plane or, in other words, positioned into a substantially parallel relation to the horizontal x, z plane (FIGS. 13 and 16 through 18) relative to and below the breast of the wearer and for displacing the breast received within the at least one breast cup upward and inward toward the center of the wearer's chest while concomitantly increasing the volume of the breast outside an upper portion of at least the one breast cup. In one aspect, the system further comprises a shaping member 160 interposed between the platform 60 and the breast, the shaping member 160 at least partially overlaying the portion of the platform 60.

Figure 19:
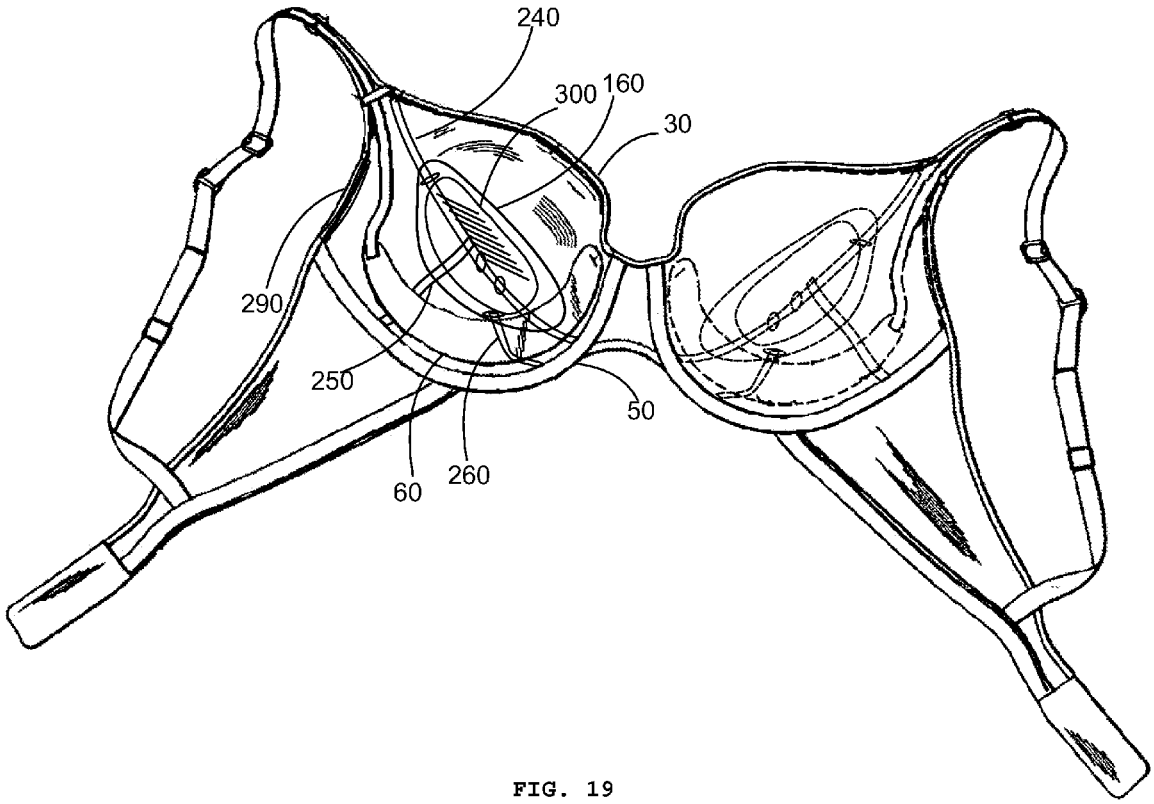
FIG. 19 shows an exploded view of the adjustable breast positioning system.

In still yet another aspect, and referring to FIG. 19, further disclosed is an apparatus 240 operationally configured to push the flexible shaping member or glove 160 down into the cup 30 so that it is not free-floating or sticking out of the gulley of the cup. This is important not only for the appearance of the bra, but especially during the purchase decision process of a potential customer. The mechanism of the apparatus 240 is sometimes referred to herein as a "leaf spring." This same apparatus 240 is beneficial in that it suitably controls the path of the flexible shaping member or glove 160. This same apparatus 240 constrains the movement of the flexible shaping member or glove 160 within a narrow range of front-to-back movement, and also allows flexible shaping member or glove 160 to glide in a left/right direction to conform to the movement of the rocker arm 60. This same apparatus 240, which is referred to as a "leaf spring," suitably helps to constrain the movement of the lower lifting part 60 (the rocker arm, or platform) within a narrow range of distance from the body of the wearer by preventing the rocker arm 60 from pivoting away from the body. Further disclosed is a glove control loop 260 which helps to keep the upper lifting or flexible shaping member or glove component (the "glove") 160 close to the body of the wearer. This glove control loop 260, which helps to keep the upper lifting or flexible shaping member or "glove" 160 close to the body of the in the proper horizontal orientation (parallel to the ground and perpendicular to the body of the wearer). Further disclosed is the feature of a reinforcement means 290, suitably a steel sidebrace (or optionally other firm material which could be high density plastic, composite, or metal), to the side of the cup. This helps to counteract the upper force exerted on the underwire 50 during the lifting process, which prevents distortion of the side of the cup 30 during the lift process. Further disclosed is a padded surface 300, which is suitably foam, to the flexible shaping member or glove which makes the lifting components "feel" softer to the wearer. Other forms of padding are contemplated and are not limited to any specific foam. A constraining loop 250 is also shown which keeps the apparatus 240 (typically a leaf spring) at a fixed distance from the body.

These aspects, among other things, demonstrate the industrial applicability of this invention.

Moreover, it should be apparent that further numerous structural modifications and adaptations may be resorted to without departing from the scope and fair meaning of the present invention as set forth hereinabove and as described herein below by the claims.

I claim:

1. A breast positioning system for women's garments, said breast positioning system comprising:

a garment, said garment comprising at least one breast cup having an available breast cup volume for receiving a breast of a wearer;

a platform situated within said at least one breast cup;

a means for applying a force to said platform while said platform is retained within the breast cup below the breast of the wearer wherein at least a portion of the breast is supported by at least a portion of said platform;

a flexible shaping member and at least one apparatus operationally configured to push the flexible shaping member down into at least one of said breast cups; and, wherein said apparatus is a leaf spring.

2. A breast positioning garment comprising:

at least one breast cup having an available breast cup volume for receiving a breast of a wearer;

a platform situated within said at least one breast cup; a means for applying a force to said platform while said platform is retained below the breast of the wearer for supporting at least a portion of the breast on at least a portion of said platform;

at least one flexible shaping member and at least one apparatus operationally configured to push the flexible shaping member down into at least one of said breast cups; and, wherein said apparatus is a leaf spring.

3. A breast positioning garment comprising:

at least one breast cup having an available breast cup volume for receiving a breast of a wearer;

a platform situated within said at least one breast cup;

a means for applying a force to said platform while said platform is retained below the breast of the wearer for supporting at least a portion of the breast on at least a portion of said platform;

at least one flexible shaping member; and, a means for constraining forward and backward movements of the flexible shaping member while allowing leftward and rightward movements within the breast cup.

* * * * *